US005461366A

United States Patent [19]

Figuereo et al.

[11] Patent Number: 5,461,366

[45] Date of Patent: Oct. 24, 1995

[54] REMOTE ALARM SYSTEM

[75] Inventors: Jean L. Figuereo, Sevres; Jean R. Hardy, Orgeval; Claude Vialatte, Antony, all of France

[73] Assignee: Compagnie d'Etudes, de Healisations et d'Installations de Systemes (Coris), France

[21] Appl. No.: 254,351

[22] Filed: Jun. 3, 1994

[30] Foreign Application Priority Data

Jun. 9, 1993 [FR] France ..... 93 06890

[51] Int. Cl.[6] ..... G08B 13/00

[52] U.S. Cl. ..... 340/574; 340/501; 340/539

[58] Field of Search ..... 340/574, 539, 340/501

[56] References Cited

U.S. PATENT DOCUMENTS

| | | | |
|---|---|---|---|
| 3,825,833 | 7/1974 | Bogue et al. | 340/574 |
| 4,998,095 | 3/1991 | Shields | 340/574 |
| 5,111,187 | 5/1992 | Heckleman et al. | 340/574 |
| 5,115,224 | 5/1992 | Kostusiak et al. | 340/574 |

*Primary Examiner*—Glen Swann
*Attorney, Agent, or Firm*—Lappin & Kusmer

[57] ABSTRACT

A remote alarm system that includes short range personal portable transmitter devices, which can be manually actuated in order to transmit a predetermined warning signal, and a plurality of fixed receiver devices disposed at suitable locations on a site to be protected, the said receiver devices being suitable for receiving the warning signal transmitted by any one of the portable devices located within range and transmitting the warning thus detected to security personnel.

This system is more especially intended for the users of public places and public transport such as, for example, the underground railway.

8 Claims, 3 Drawing Sheets

REMOTE ALARM SYSTEM

FIELD OF THE INVENTION

The present invention relates to a remote alarm system intended, more particularly, for the users of public places and public transport.

BACKGROUND OF THE INVENTION

Insecurity is known to be presently one of the chief preoccupations of our society. Certain public places and forms of public transport, such as the underground railway for example, are, of course, already equipped with alarm devices. However, the use of these conventional alarm devices poses problems for the users, which problems may be of a physical nature—inability to reach the nearest alarm device—or of a moral nature—the fear of attracting attention in the event of aggression.

SUMMARY OF THE INVENTION

The main aim of the present invention is thus to remedy these drawbacks and, in order to do so, it proposes a remote alarm system that is essentially charcterized in that it includes personal portable short range transmitter devices that can be actuated manually in order to transmit a predetermined warning signal, and a plurality of fixed receiver devices disposed at suitable locations on a site to be protected, these receiver devices being suitable for receiving the warning signal transmitted by any one of the portable devices that is within range and of re-transmitting the warning thus detected to security personnel.

The personal nature of the emitter device thus guarantees a measure of discretion and it is further immediately available as it is carried by the user, for example in a pocket or a handbag. Such a remote alarm system thus offers complementary security in relation to the conventional means implemented by the authorities.

Preferably, the portable transmitter device is disposable and cannot be dismantled without being destroyed. In other words, it can only be used once, which considerably reduces the likelihood of false alarms.

Preferably also, the portable transmitter device has a validity of operation that is limited in time, which makes it possible to finance the installation and maintenance of the fixed equipment solely through the sale of the portable devices.

Furthermore, the portable transmitter device, once actuated, has a duration of operation that is limited in time.

Advantageously, the remote alarm system according the invention further comprises at least one mobile receiver device, fitted with a directional antenna, so as to enable the transmitter device that has triggered the alarm to be located.

In one particular form of embodiment of the invention, the portable transmitter device is constituted by a small sized box containing a radio transmitter capable of being supplied from an independent power source via a switch operated by a button projecting from the surface of the box.

Preferably, the switch operating button is normally covered by a protective cap that is rendered integral with the box and which can only be detached therefrom by breaking a holding pin.

Thus, the alarm cannot be triggered involuntarily since it is necessary, first of all, to remove the protective cap in a deliberate, irreversible action; only then can the operating button be actuated.

Advantageously, the operating button is of the pushbutton type and comprises a non-return system, so that it cannot be actuated more than once.

In a particular form of embodiment of the invention, the radio transmitter is associated with a modulator characterizing its validity date, which makes it possible to confer upon each portable device a period of validity of operation that is limited in time, taking account of the rate of replacement considered to be necessary.

In addition, as a variant, each portable device has a personal code which is transmitted at the same time as the warning signal, which makes it possible, if necessary, to identify, by means of a data base, the person who has triggered the alarm.

BRIEF DESCRIPTION OF THE DRAWINGS

Various forms of embodiment of the invention are described herebelow by way of example, with reference to the annexed drawings, wherein.

DETAILED DESCRIPTION OF THE DRAWINGS

Figure 1:
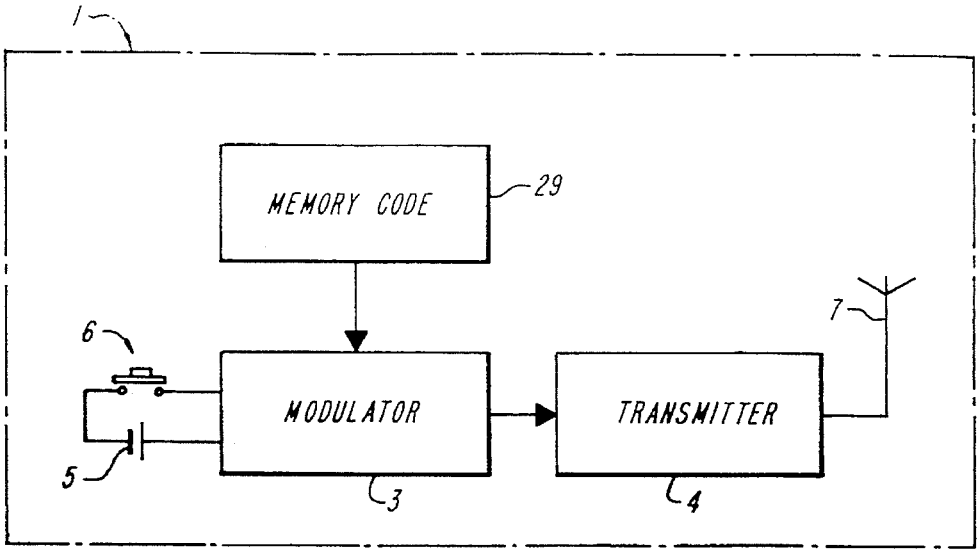
FIG. 1 is a block diagram of a personal portable transmitter device forming part of the remote alarm system according to the invention.
Figure 2:
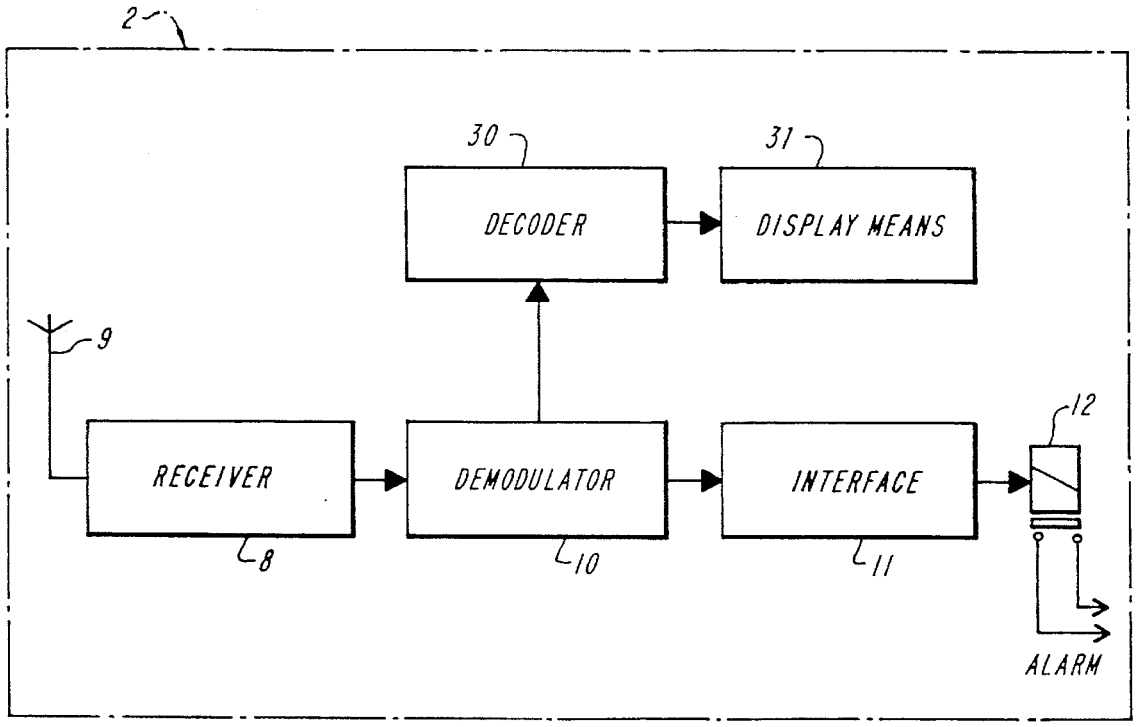
FIG. 2 is a block diagram of a receiver device forming part of the said remote alarm system.

The remote alarm system according to the invention is essentially composed of personal portable transmitter devices 1, of the type diagrammatically represented in FIG. 1, and of receiver devices 2, of the type diagrammatically represented in FIG. 2, disposed at suitable fixed locations on a site to be protected, such as a public place, for example the confines of the underground railway. Such fixed devices can, of course, be placed not only be in the corridors or the stations, but also on board the underground trains.

Portable transmitter device 1 is essentially constituted by a modulator 3 and by a radio transmitter 4, capable of being supplied from an independent power source such as a battery 5, via a manually actuated switch 6, in order to transmit a predetermined warning signal. Radio transmitter 4 is associated with a transmitting antenna 7 and it will, preferably, have a short range, for example a hundred yards or so.

As to receiver device 2, it is essentially constituted by a radio receiver 8 associated with a receiving antenna 9 and suitable or receiving the warning signal transmitted by any one of the portable devices 1 located within range. This radio receiver is followed by a demodulator 10 and by an interface 11 associated with a relay 12. Thus, when the receiver 8 receives a warning signal, relay 12 is actuated and, by known means, enables the alarm to be re-transmitted to surveillance personnel in the vicinity with a view to swift on-the-spot intervention. If necessary, the alarm can also be re-transmitted directly to the police.

Figure 4:
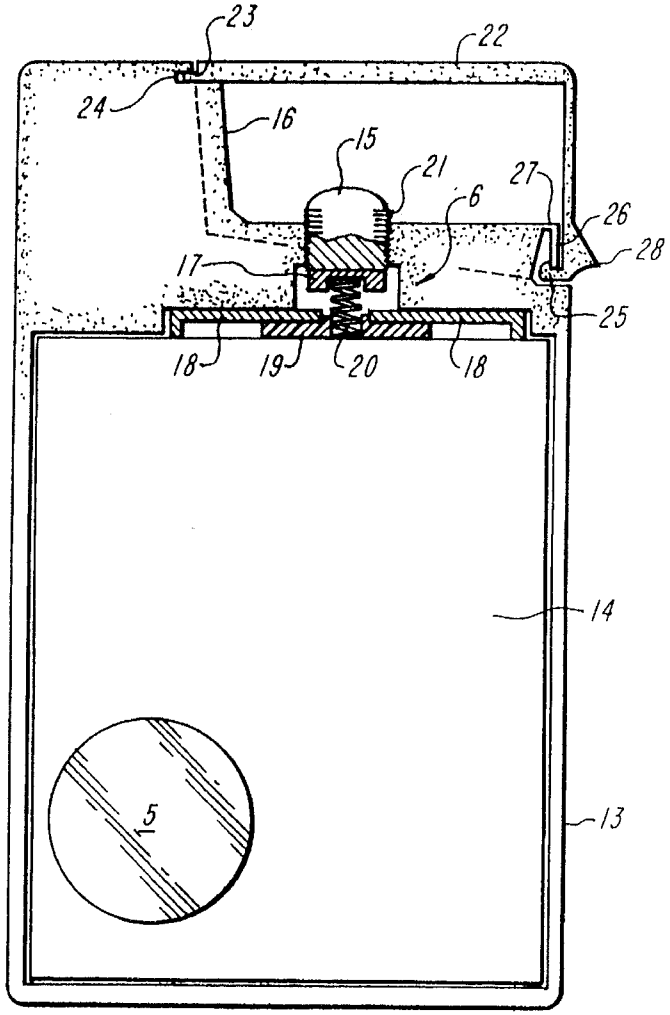
FIG. 4 is a cross-sectional view of the said device.
Figure 3:
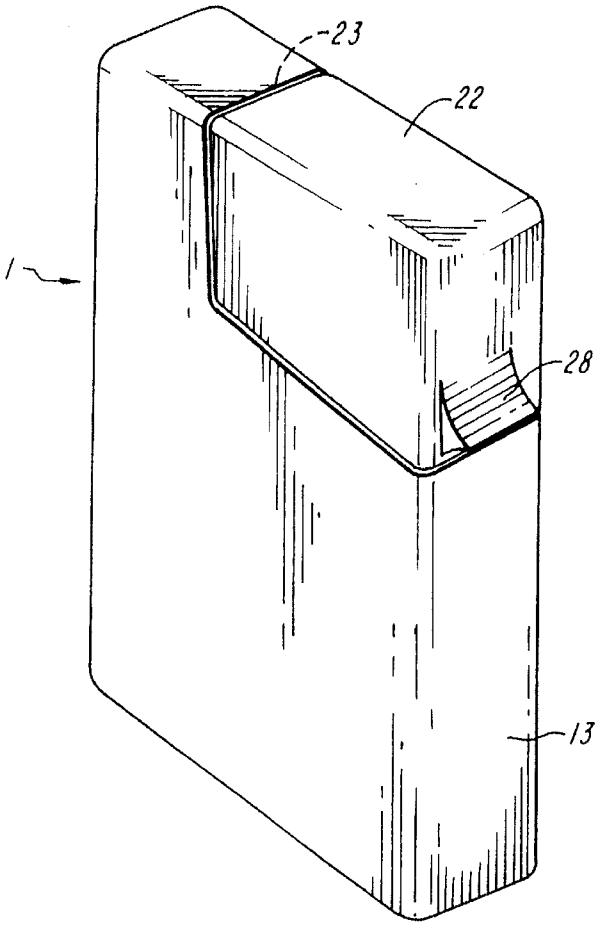
FIG. 3 is a perspective view of a practical form of embodiment of the personal portable transmitter device represented in FIG. 1.
Figure 5:
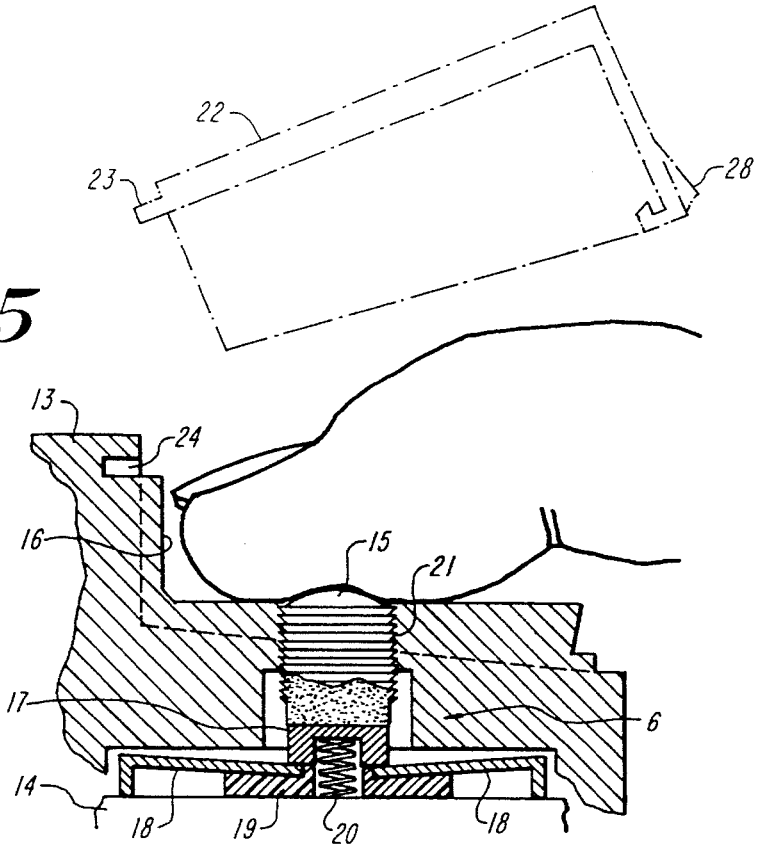
FIG. 5 is a larger scale partial view illustrating the operation of such a device.

In the practical form of embodiment shown in FIGS. 3 to 5, the personal portable transmitter device 1 is constituted by a small sized parallepipedical box 13 of moulded, sealed plastic, the dimensions of which will be similar to those of a lighter, for example 70 mm high, 35 mm wide and 10 mm thick, so that it can be held discreetly in the hand.

Inside this box, and as shown in FIG. 4, is located the supply battery 5 and a printed circuit 14 carrying transmitter 4 and modulator 3, the transmitting antenna 7 being directly integrated in the box. As to switch 6, it takes the form, here, of a pushbutton 15 projecting from the surface of the box into a cut out portion 16 provided for this purpose. This pushbutton is made entirely of plastic material and comprises, on its lower portion, a conductive metallic piece 17 capable of establishing electrical contact between two metallic tabs 18 forming part of printed circuit 14 and which are supported by flexible insulating pieces 19. A spring 20 is further placed between pushbutton 15 and printed circuit 14.

According to one characteristic of the present invention, portable transmitting device 1 is designed to be disposable. In other words, when it is actuated for the first time in order to transmit a warning signal, it cannot be used again and it is essential for it to be replaced. For this purpose, pushbutton 15 is provided, on its periphery, with a toothed portion 21 cooperating with a toothed portion of a matching shape provided in the wall of box 13, these toothed portions being orientated in such a way that, when the button is pressed down against the action of the spring 20, it cannot rise up again.

Furthermore, the housing of pushbutton 15 is normally covered by a protective cap 22, secured to box 13 via a tab 23 engaging in a groove 24 in the box and a hook-shaped portion 25 snapping into engagement on a holding pin 26 provided with a break-off portion 27. A projecting grip lug 28 is further provided on cap 22 at the hook-shaped portion 25.

Thus, in order to actuate the device, it is necessary to perform two successive deliberate actions, which can be performed with one hand and which have the effect of irremediably modifying the said device. The alarm cannot, therefore, be triggered involuntarily as a result of nervous or accidental manipulation of the said device.

Indeed, in order to trigger an alarm, the user carrying such a device must firstly raise the protective cap 22 by pressing with the thumb on projecting lug 28 provided for this purpose, while holding the box 13 between the palm of the hand and the other fingers, as with a lighter. To do so, the user has to overcome the resistance afforded by holding pin 26, which finally breaks at its break-off portion 27. Cap 22 is thus unlocked, but cannot be put back into place on the box owing to the breaking of pin 26.

Pushbutton 15 is thus accessible and the user must, therefore, exert a pressure on this button, again using the thumb, as illustrated in FIG. 5. In so doing, the user firstly encounters mechanical resistance due to the non-return system formed by toothed portions 21, to which the resistance afforded by spring 20 will subsequently be added, in proportion as the button is depressed.

At the end of travel, conductive metallic piece 17 of the button comes to bear on the two metallic tabs 18, closing the supply circuit of the transmitter carried by printed circuit 14. The force exerted by the button on the tabs compresses the flexible isolating pieces 19 and, when the user releases the pressure on the button, the latter cannot rise up again owing to the non-return system, while the said flexible pieces maintain the electrical contact by absorbing the mechanical play inherent in such a system.

Transmitter 4 of portable device 1 thus continuously transmits a predetermined warning signal and does so, preferably, for a period limited, for example, to a few minutes, in order not to saturate receiver 8 of fixed installation 2. This limited period of operation can easily be ensured through the more or less rapid depletion of energy source 5, but it goes without saying that the same result could also be obtained by other means, for example a timer or a clock.

According to another feature of the invention, portable transmitter device 1 also has a period of validity of operation that is limited in time. For this purpose, it transmits in its frequency band a signal encoded by modulator 3 that can be identified by receiver 8 of the fixed installation 2. The list of identifiable codes is loaded into the fixed installation and it is thus possible to deactivate series of codes corresponding to equipment considered obsolete.

Once its period of validity of operation, which is advantageously marked indelibly on the body of box 13, has expired, the portable device will no longer be recognized by the fixed installations and will thus become unusable. This will make it possible to renew the stock of portable devices at regular intervals and thus finance the equipment and operating costs of the fixed installations. Such an arrangement will also make it possible to achieve a certain mesure of protection against the manufacture of pirate devices. Another arrangement for combatting piracy through the re-use of the device consists in manufacturing box 1 so that it cannot be dismantled without destroying printed circuit 14.

In a variant of the invention, each portable device 1 further possesses an individual code that is transmitted at the same time as the warning signal, thanks to a code memory 29 associated with the modulator 3, as represented in FIG. 1. Fixed receiver device 2 is then equipped with a decoder 30 and a display means 31, as shown in FIG. 2. It is thus possible to keep a trace of the code generated in a memory at the central station, which enables the giver of the alarm to be identified subsequently, if necessary, by means of a data bank.

Figure 6:
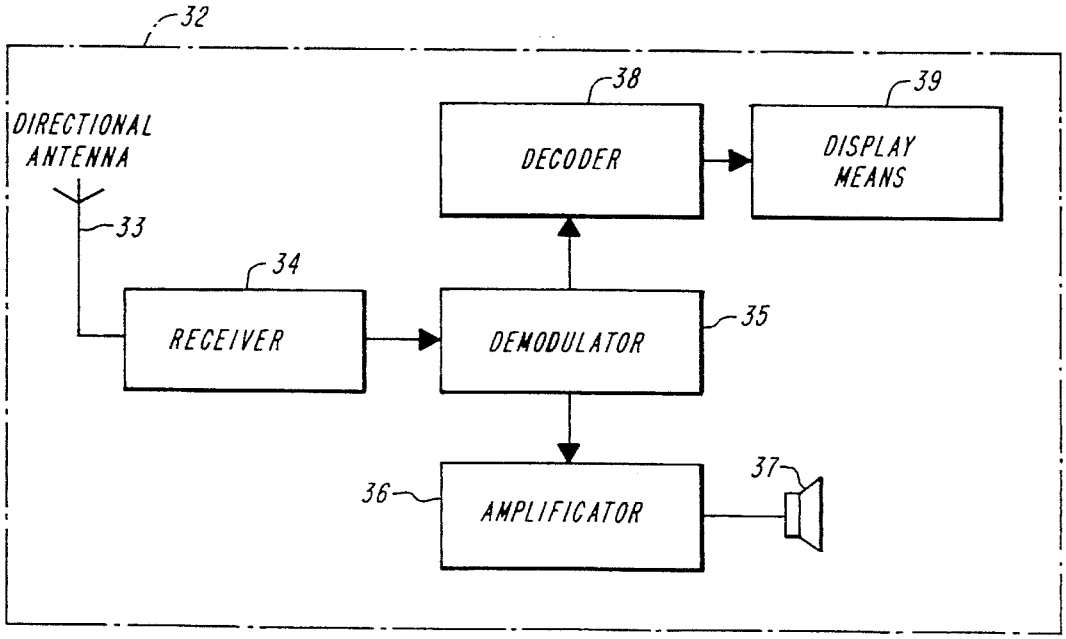
FIG. 6 is a block diagram of a mobile receiver device forming part of the remote alarm system, in a variant of the invention.

In another variant of the invention, the remote alarm system is completed by a number of mobile receiver devices 32, such as the one shown in FIG. 6. This device includes a directional antenna 33 followed by a receiver 34, a demodulator 35 and an amplifier 36 associated with a loudspeaker 37. If necessary, this device can also include a decoder 38 and a display means 39 in the event of an individual code being used for each portable transmitter device.

Thanks to its directional capabilities, such a mobile receiver device 32 will enable the security personnel to locate, for example in a crowd, the area in which the transmitter in warning condition is located, by taking their bearings in accordance with the acoustic power furnished by the loudspeaker. The acoustic system could, of course, be replaced or supplemented by a system using light or some other system.

It can thus be appreciated, to sum up, that the remote alarm system according to the invention that has just been described will make it possible to respond efficiently to the problem of insecurity in public places. Indeed, a user carrying a miniaturized personal portable transmitter device 1 according to the invention can, when he or she is a victim or witness of an assault or an accident, discreetly and instantaneously alert the police or the security agents using this device. He or she will then be located easily thanks to the message transmitted by the fixed receiver device 2 located within range, and then possibly with greater accuracy thanks to a mobile receiver device 32. This will make it possible to reduce the number of surveillance teams and to take steps in advance in order to prevent the aggressor or aggressors from escaping, such as, for example, locking the entrances of the place thus under surveillance.

We claim:

1. A remote alarm system comprising a plurality of short range, personal, portable, disposable transmitter devices for transmitting a predetermined warning signal in response to manual actuation, and having a validity of operation that is limited in time, and a plurality of fixed receiver devices, disposed at suitable locations on a site to be protected, for receiving a warning signal transmitted by any one of the transmitter devices located within the range of the actuated transmitter device and for transmitting the warning thus detected to security personnel.

2. A remote alarm system according to claim 1 wherein at least one of the transmitter devices, once actuated, has a period of operation that is limited in time.

3. A remote alarm system according to claim 1 further comprising at least one mobile receiver device, provided with a directional antenna, for locating at least one of the transmitter devices when actuated.

4. A remote alarm system according to claims 1, 2, or 3 wherein one or more of the transmitter devices comprises a small sized box containing a radio transmitter capable of being supplied with energy from an independent energy source via a switch operated by a button projecting from a surface of the box.

5. A remote alarm system according to claim 4, wherein the operating button of the switch is normally covered by a protective cap rendered integral with the box and which can only be detached therefrom by breaking a holding pin.

6. A remote alarm system according to claim 4, wherein the operating button is of the pushbutton type and comprises a non-return system so that it can only be actuated once.

7. A remote alarm system according to claim 4 wherein the radio transmitter is associated with a modulator, characterizing its validity date.

8. A remote alarm system according to claim 7, wherein at least one of the transmitter devices possesses an individual code which is transmitted at the same time as the warning signal.

* * * * *